US009577372B1

(12) United States Patent
Kakish et al.

(10) Patent No.: US 9,577,372 B1
(45) Date of Patent: Feb. 21, 2017

(54) MAGNETIC REVERSIBLE POWER AND DATA CONNECTOR

(71) Applicant: Western Digital Technologies, Inc., Irvine, CA (US)

(72) Inventors: Musa I. Kakish, Anaheim, CA (US); John E. Maroney, Irvine, CA (US); Charles A. Neumann, Lake Forest, CA (US)

(73) Assignee: WESTERN DIGITAL TECHNOLOGIES, INC., Irvine, CA (US)

( * ) Notice: Subject to any disclaimer, the term of this patent is extended or adjusted under 35 U.S.C. 154(b) by 0 days.

(21) Appl. No.: 14/871,139

(22) Filed: Sep. 30, 2015

(51) Int. Cl.

| | |
|---|---|
| ***H01R 11/30*** | (2006.01) |
| ***H01R 13/62*** | (2006.01) |
| ***H01R 13/717*** | (2006.01) |
| ***H01R 13/642*** | (2006.01) |

(52) U.S. Cl.
CPC ..... *H01R 13/6205* (2013.01); *H01R 13/642* (2013.01); *H01R 13/7175* (2013.01)

(58) Field of Classification Search
CPC ..... H01R 13/642; H01R 13/7175; H01R 13/6205; H01R 11/30; H01R 13/64; H01R 31/06; H01R 13/2421
USPC ..... 439/38–40, 217–218, 700
See application file for complete search history.

(56) References Cited

U.S. PATENT DOCUMENTS

| | | | | |
|---|---|---|---|---|
| 7,311,526 | B2 * | 12/2007 | Rohrbach | H01R 13/6205 439/218 |
| 7,371,073 | B2 | 5/2008 | Williams | |
| 7,701,705 | B1 | 4/2010 | Szeremeta | |
| 8,064,194 | B2 | 11/2011 | Szeremeta | |
| 8,113,873 | B1 | 2/2012 | Sarraf | |
| 8,133,426 | B1 | 3/2012 | Yurchenco et al. | |
| 8,358,395 | B1 | 1/2013 | Szeremeta | |
| 8,417,979 | B2 | 4/2013 | Maroney | |
| 8,462,460 | B1 | 6/2013 | Szeremeta et al. | |
| 8,498,088 | B1 | 7/2013 | Klein | |
| 8,547,658 | B1 | 10/2013 | Szeremeta | |
| 8,794,980 | B2 * | 8/2014 | McCormack | H01R 13/6205 439/39 |
| 2007/0020960 | A1 | 1/2007 | Williams | |
| 2007/0141863 | A1 | 6/2007 | Williams | |
| 2013/0117470 | A1 * | 5/2013 | Terlizzi | H01R 13/6683 710/3 |
| 2014/0148018 | A1 | 5/2014 | Kim | |
| 2015/0010275 | A1 * | 1/2015 | DiFonzo | G02B 6/3817 385/53 |

(Continued)

*Primary Examiner* — Edwin A. Leon
(74) *Attorney, Agent, or Firm* — Young Law Firm, P.C.

(57) ABSTRACT

A connector may include at least one power conductor configured to supply power to an electronic device; at least one ground conductor to supply a ground to the electronic device; at least one data conductor configured to carry data to or from the electronic device; optionally, one or more connector orientation conductors; a first magnet on a first side of the connector; and a second magnet on a second side of the connector. The connector may be reversible to be magnetically-connectable to a mating connector in a first orientation and in a second orientation that is 180 degrees from the first orientation. The connector may be operative to carry data and power to and/or from the mating connector when connected to the mating connector in the first orientation or in the second orientation.

28 Claims, 7 Drawing Sheets

(56) References Cited

U.S. PATENT DOCUMENTS

2016/0093999 A1* 3/2016 Powers ..... H01R 31/06
439/39

* cited by examiner

FIG. 1A
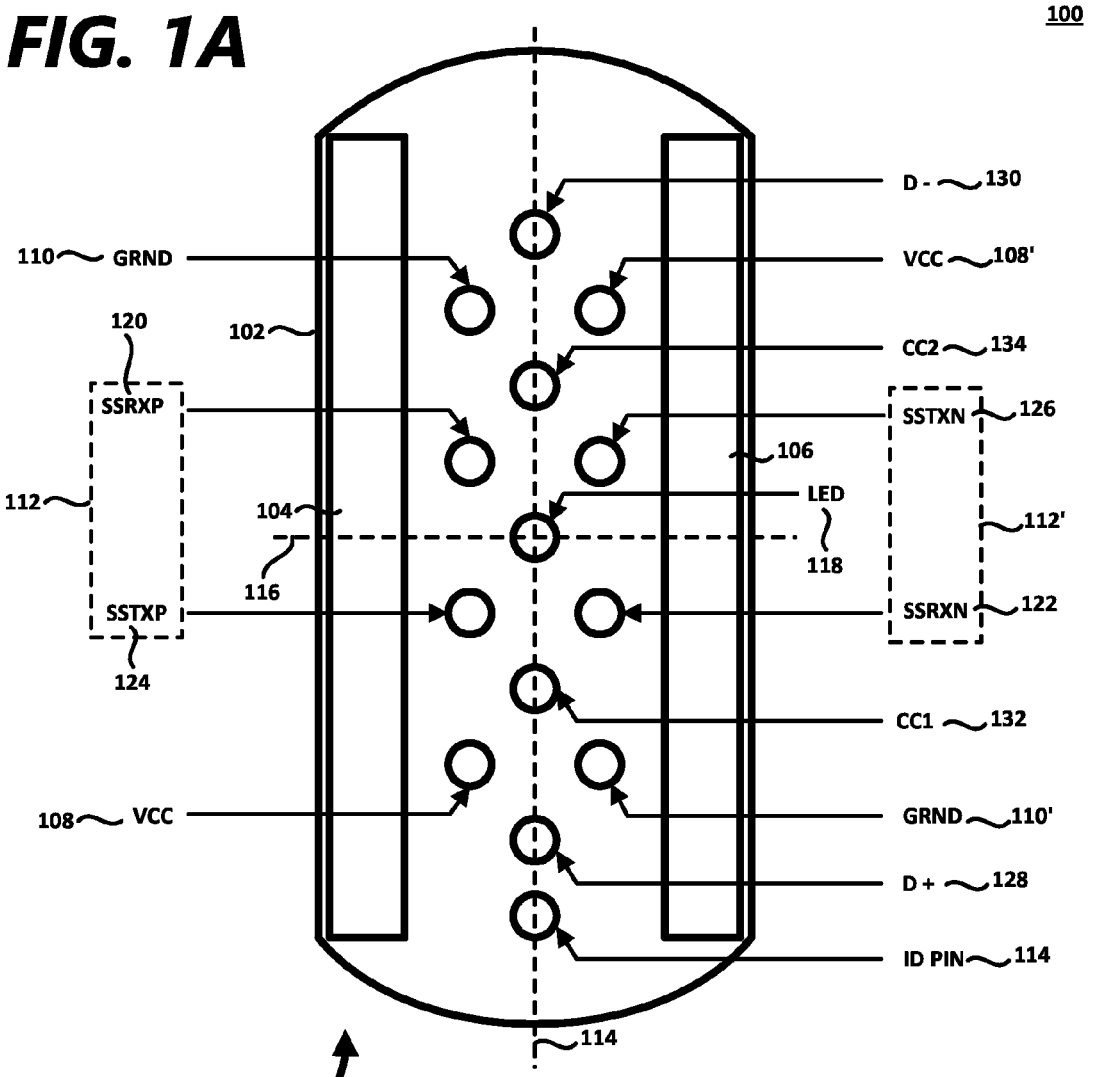
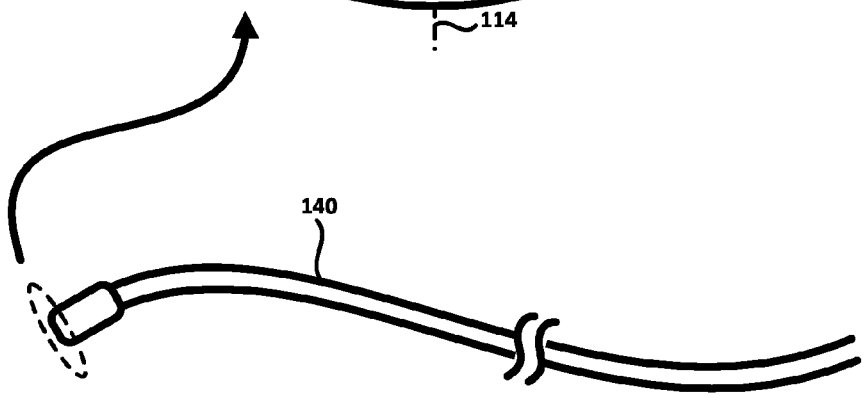
FIG. 1B

MAGNETIC REVERSIBLE POWER AND DATA CONNECTOR

BACKGROUND

Connectors for data and power, such as those connectors designed as Universal Serial Bus (USB) connectors, must typically be inserted into a mating connector in a specific orientation, to ensure that the data and power connection between connector (e.g., male) and mating connector (e.g., female) match up to one another. This is cumbersome to the user and can result in bent connector pins as the user may, often blindly, attempt to mate connectors in the incorrect orientation.

BRIEF DESCRIPTION OF THE DRAWINGS

FIG. 1A is a representation of a power and data connector according to one embodiment.

FIG. 1B shows a portion of a cable incorporating the connector shown in FIG. 1A.

DETAILED DESCRIPTION

Figure 2A:
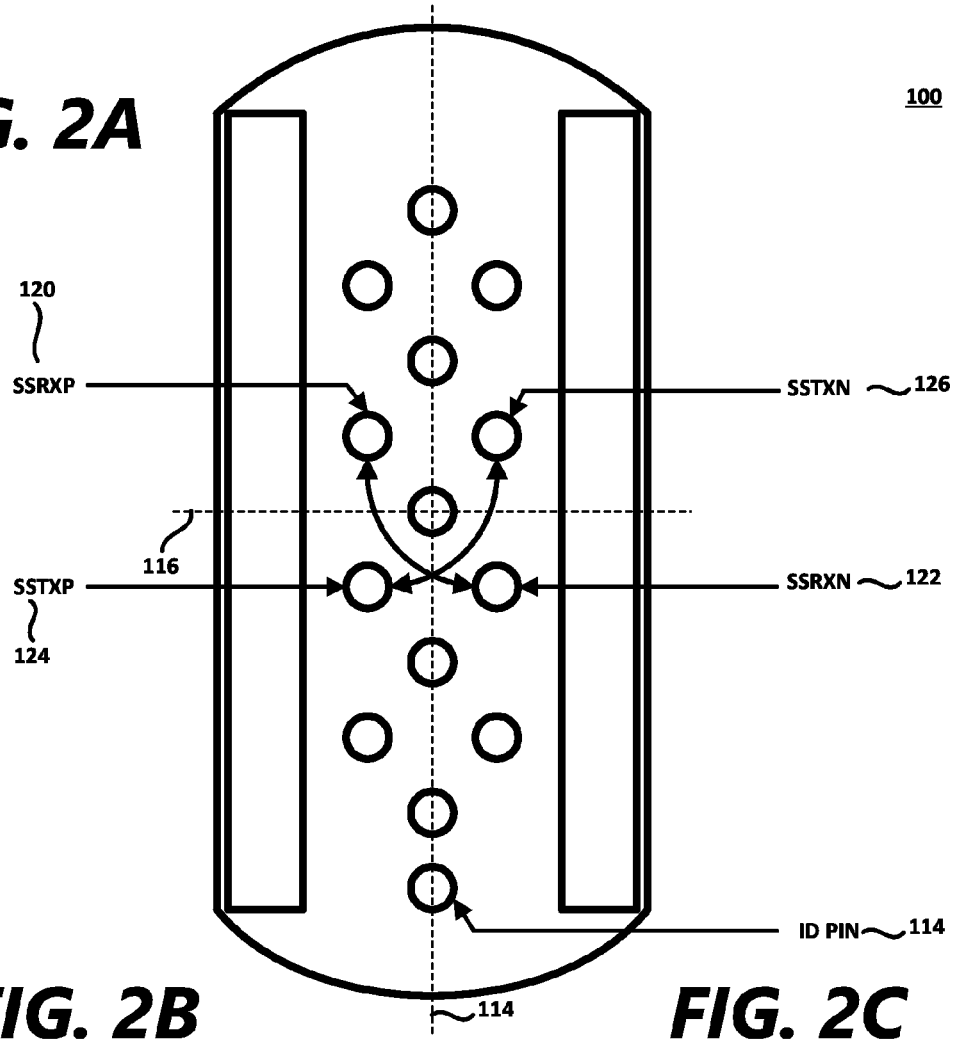
FIG. 2A is a representation of a power and data connector according to one embodiment, showing the reversibility of the data pins.
Figure 2B:
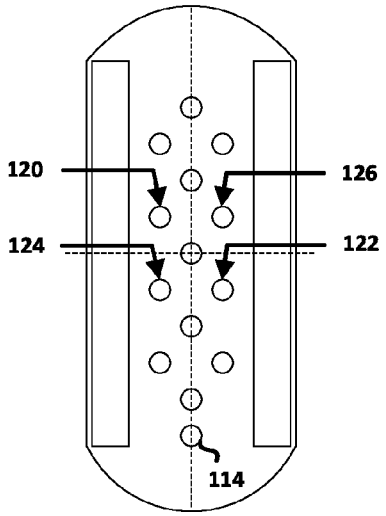
FIG. 2B is a representation of the connector of FIG. 2A, to illustrate further aspects of one embodiment.
Figure 2B:
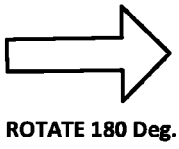
Figure 2C:
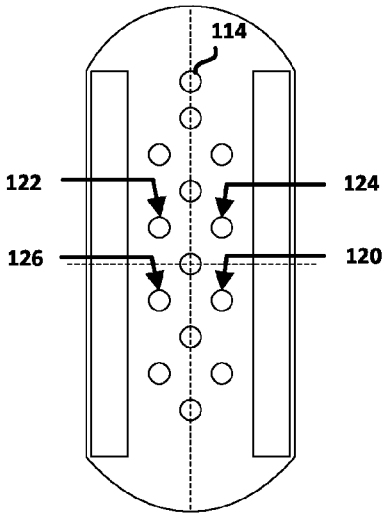
FIG. 2C is a representation of the connector of FIG. 2B, rotated 180 degrees, to illustrate the reversibility of the connector 100, according to one embodiment.

One embodiment is a high-speed serial data connector which, in one implementation, may be configured to conform to the Universal Serial Bus (USB) SuperSpeed/+ specification. Advantageously, the pin-out definition of a serial connector according to one embodiment reduces the number of costly (e.g., Pogo) pins needed to make the necessary electrical connections and provides flexibility of use fully reversibility. A Pogo pin is a device used in electronics to establish a (usually temporary) electrical connection between, for example, two printed circuit boards. Named by analogy with the pogo stick toy, Pogo pins may be configured as slender cylinders containing two sharp, spring-loaded pins. Pressed between two electronic circuits, the sharp points at each end of the Pogo pin make secure electrical contacts between the two electronic circuits. Pogo is a registered trademark of Everett Charles Technologies (ECT). The power and data connectors described and shown herein may make use of Pogo pins or may utilize some other structures or technology for the disclosed electrical connections.

FIG. 1A is a representation of a power and data connector according to one embodiment. As shown therein, connector 100 may comprise, according to one embodiment, a connector body 102 and a connector face comprising one or more power and data conductors configured to supply power and allow the exchange of data to and from an electronic device such as, for example, a data storage device. In the implementation shown in FIG. 1A, two Vcc power conductors are shown at 108 and 108'. The connector 100 is also shown to comprise one or more ground conductors to supply a ground (e.g., a voltage reference) to the electronic device. In the implementation of FIG. 1A, the connector 100 comprises two ground conductors, shown at reference numerals 110 and 110'. As also shown, the connector 100 also comprises one or more data conductors configured to carry data to or from the electronic device. The data conductors of connector 100 are shown at 112 and 112'. As shown in FIG. 1A, the connector 100 also comprises a connector orientation conductor, labeled "ID PIN" at reference numeral 114. A first magnet 104 may be provided on a first side of the connector 100 and a second magnet may be provided on a second side (substantially opposite the first side, in one embodiment) of the connector 100.

According to one embodiment, the connector 100 may be reversible such that the connector is magnetically-connectable to a mating connector in a first orientation as well as in a second orientation that is 180 degrees from the first orientation, with the connector 100 being operative to carry data and power to and/or from the mating connector when connected to the mating connector either in the first orientation or in the second orientation. This may be carried out, according to one embodiment, by a mostly symmetrical arrangement of the conductor pins. This drives down the total cost of manufacturing and enables the connector 100 to be inserted into a mating connector in either a first orientation or in a second orientation that is 180 degrees from the first orientation, with the connector 100 being operative to carry power and data in either configuration.

As shown in FIG. 1A, the distribution of the conductors (at least the power conductors 108, 108', the ground conductors 110, 110' and the data conductors 112, 112') may be, according to one embodiment, symmetrical about a first symmetry axis 114 and/or a second symmetry axis 116. In the embodiment shown in FIG. 1A, the power conductors 108, 108', the ground conductors 110, 110' and the data conductors 112, 112' are symmetrical about both symmetry axes 114 and 116.

As also shown in FIG. 1A, the connector 100 may further comprise a light source, such as a light-emitting diode (LED) connector 118 that may be coupled to a LED configured to illuminate when the connector is connected to the mating connector and/or data flows between the connector 100 and the mating connector. In one embodiment, the LED connector may be configured as a light pipe and may be configured to show illumination from the LED on the outside surface of the connector 100 when the connector is magnetically-connected to the mating connector and/or when data flows between the connector and mating connector. This provides an instant view of the status of the connector 100 to the user. Indeed, when the connector 100 is coupled to a mating connector and power and/or data flows between the two, the connector 100 is illuminated via the LED connector 118 and when the connector 100 is not properly coupled to the mating connector and/or when data and/or power do not flow therebetween, the connector 100 is not illuminated via the LED connector 118. In one embodiment, the LED conductor may be substantially centered on the connector 100, as shown in the implementation of FIG. 1A in which the LED connector 118 is disposed at the intersection of the symmetry axes 114 and 116.

As shown at 112 and 112', the data conductors may comprise a first differential receiver conductor 120, a second differential receiver conductor 122, a first differential transmitter conductor 124 and a second differential transmitter conductor 126. In one embodiment, the first and second differential receiver conductors 120, 122 are of opposite polarities from one another and the first and second differential transmitter conductors 124 and 126 are likewise of opposite polarities relative to one another. In one embodiment, the first differential receiver conductor 120 and the first differential transmitter conductor 124 may be configured to accommodate a positive polarity and the second differential receiver conductor 122 and the second differential transmitter conductor 126 may be configured to accommodate a negative polarity.

As shown in FIG. 1A, in one embodiment of the connector 100, the connector orientation conductor 114 may be configured to enable the determination of polarities of the first and second differential receiver conductors and to enable a determination of polarities of the first and second differential transmitter conductors when the connector 100 is magnetically-connected to the mating connector in the first or in the second orientation. Indeed, according to one embodiment, the connector orientation conductor 114 (the ID PIN), may be the only non-symmetrically-disposed conductor on the connector 100. Therefore, if the connector orientation conductor 114 makes contact with a counterpart of the mating connector, one of the first differential receiver conductors 120, 122 will be identified as being of the positive polarity and the other one of the differential receiver conductors 120, 122 will be identified as being of the negative polarity. Similarly, if the connector orientation conductor 114 fails to make contact with a counterpart of the mating connector (i.e., it floats), one of the second differential transmitter conductors 124, 126 will be identified as being of the positive polarity and the other one of the differential receiver conductors 124, 126 will be identified as being of the negative polarity.

According to one embodiment, the connector 100 may be compatible with Universal Serial Bus (USB) USB, an industry standard that defines the cables, connectors and communications protocols used in a bus for connection, communication, and power supply between computers and electronic devices. Indeed, according to one embodiment, the connector 100 is Universal Serial Bus (USB) 3.1 (also called SuperSpeed and SuperSpeed+) and above compatible. In FIG. 1A, the first differential receiver conductor 120 may be the SSRXP conductor, the Positive Differential receiver of the SuperSpeed bus standard; the second differential receiver conductor 122 may be the SSRXN conductor, the Negative Differential receiver of the SuperSpeed bus standard, the first differential transmitter conductor 124 may be the SSTXP conductor, the Positive Differential Transmitter of the SuperSpeed bus standard and, finally, the second differential transmitter conductor 126 may be the SSTXN conductor, the Negative Differential Transmitter of the SuperSpeed bus standard.

As shown in FIG. 1A, the connector 100 may comprise data conductors in addition to those shown at 112 and 112'. Indeed, according to one embodiment, the data conductors of the connector 100 may further comprise a first legacy data conductor 128 and a second legacy data conductor 130. In one embodiment, the first legacy data conductor 128 may be a positive polarity data conductor and the second legacy data conductor 130 may be a negative polarity data conductor. In one embodiment, the first and second legacy data conductors 128, 130 may provide interoperability with the USB2/1.1/1.0 standards. As shown, the first and second legacy data conductors 128, 130 may be disposed symmetrically about one of the axes of symmetry shown at 114 and 116. In the implementation of FIG. 1A, the first and second legacy data conductors 128, 130 are disposed symmetrically about the first axis of symmetry 114.

Lastly, the connector 100 may comprise channel configuration pins, such as shown at 132 and 134. These channel configuration conductors or pins, also labeled as CC1 and CC2 in FIG. 1A, may be implemented as channel configuration pins to comply with Power Deliver Specification 1.2 and Type-C USB connectors. As shown, the first and second channel configuration conductors 132, 134 may be disposed symmetrically about one of the axes of symmetry shown at 114 and 116. In the implementation of FIG. 1A, the first and second channel configuration conductors 134, 136 are disposed symmetrically about the first axis of symmetry 114.

As suggested at FIG. 1B, the connector 100 may be incorporated into a cable 140, in either a male or female configuration.

FIG. 2 shows the connector 100 of FIG. 1A, and illustrates the manner in which the connector orientation conductor (ID PIN) 114 may be used an indicia of orientation and the manner in which symmetrical transmitter and receiver differential pairs may be swapped depending upon the orientation. As shown therein, in one orientation in which the connector orientation conductor 114 is in a first position (i.e., mates with a counterpart conductor) shown in FIGS. 2A and 2B, the first differential receiver conductor SSRXP is mapped to the top left data conductor shown at 120, and the second differential receiver conductor SSRXN is mapped to the bottom right data connector shown at 122. Similarly, the first differential transmitter conductor SSTXP is mapped to the bottom left data conductor shown at 124, and the second differential transmitter conductor SSTXN is mapped to the top right data connector shown at 126. As suggested in FIG. 2C, in which the connector 100 has been rotated 180 degrees, the connector orientation conductor 114 is in now a second position (i.e., floating, does not contact with a counterpart conductor), the first differential receiver conductor SSRXP is mapped to the bottom right data conductor shown at 120 in FIG. 2C, and the second differential receiver conductor SSRXN is mapped to the top left connector shown at 122 in FIG. 2C. Similarly, the first differential transmitter conductor SSTXP in the rotated connector 100 shown in FIG. 2C is now mapped to the top right data conductor shown at 124, and the second differential transmitter conductor SSTXN is now mapped, in the rotated connector 100 of FIG. 2C, to the bottom left data connector shown at 126.

Figure 3:
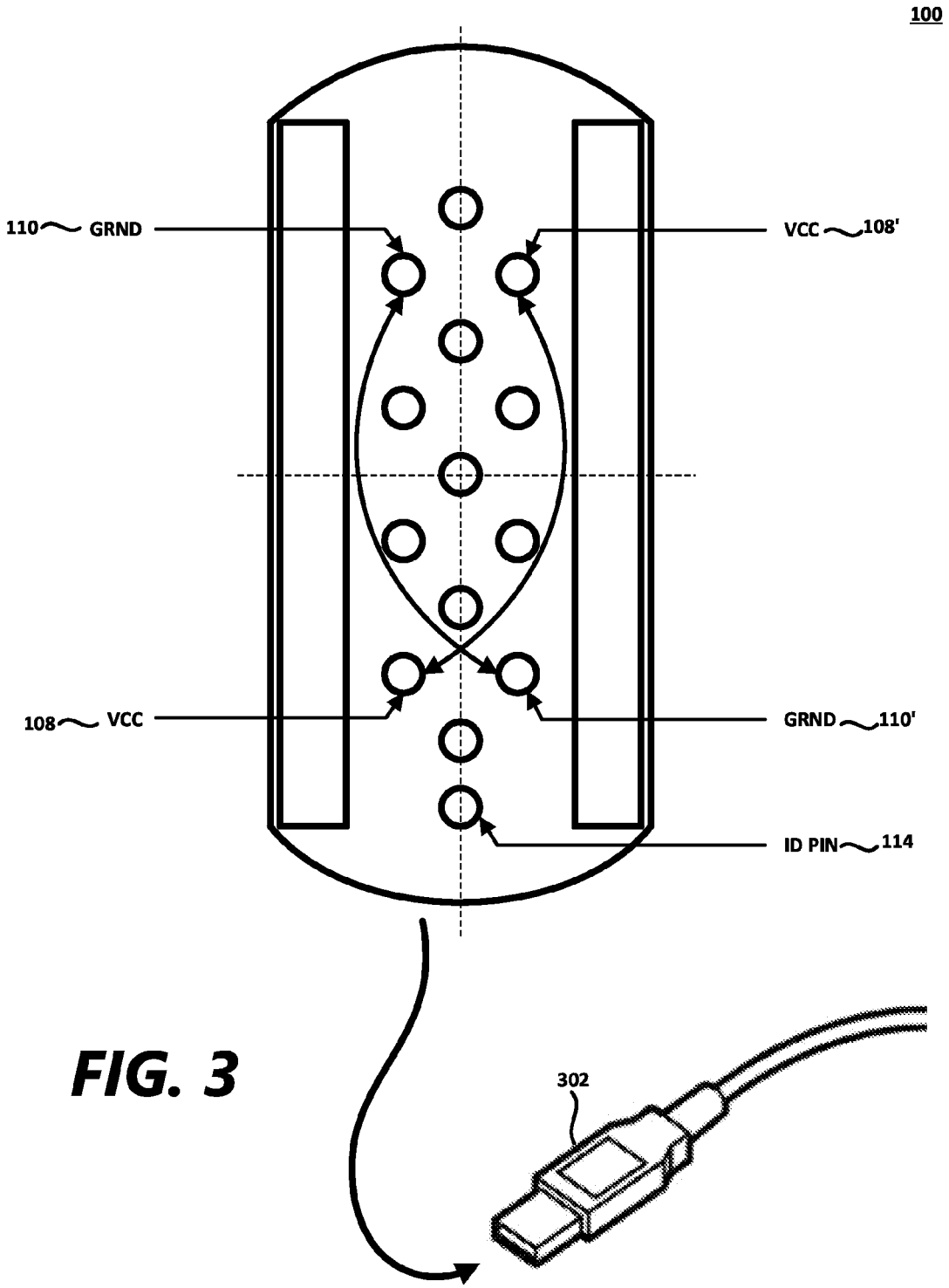
FIG. 3 is a representation of a power and data connector according to one embodiment, showing the reversibility of the power pins.

FIG. 3 is a representation of a power and data connector 100 according to one embodiment, showing the reversibility of the power pins. As shown therein, irrespective of the position (e.g., at the top or bottom of connector 100) of the orientation of the connector orientation conductor 114, a ground conductor will be present at the conductors shown at reference numerals 110 and 110' (top left and bottom right) and a power conductor will be present at reference numerals 108 and 108' (bottom left and top right). This ensures that power and ground are supplied irrespective of the orientation of the connector 100 relative to its mating connector. As also suggested, at 302, the connector 100 may be accommodated within the known USB physical form factor.

Figure 4:
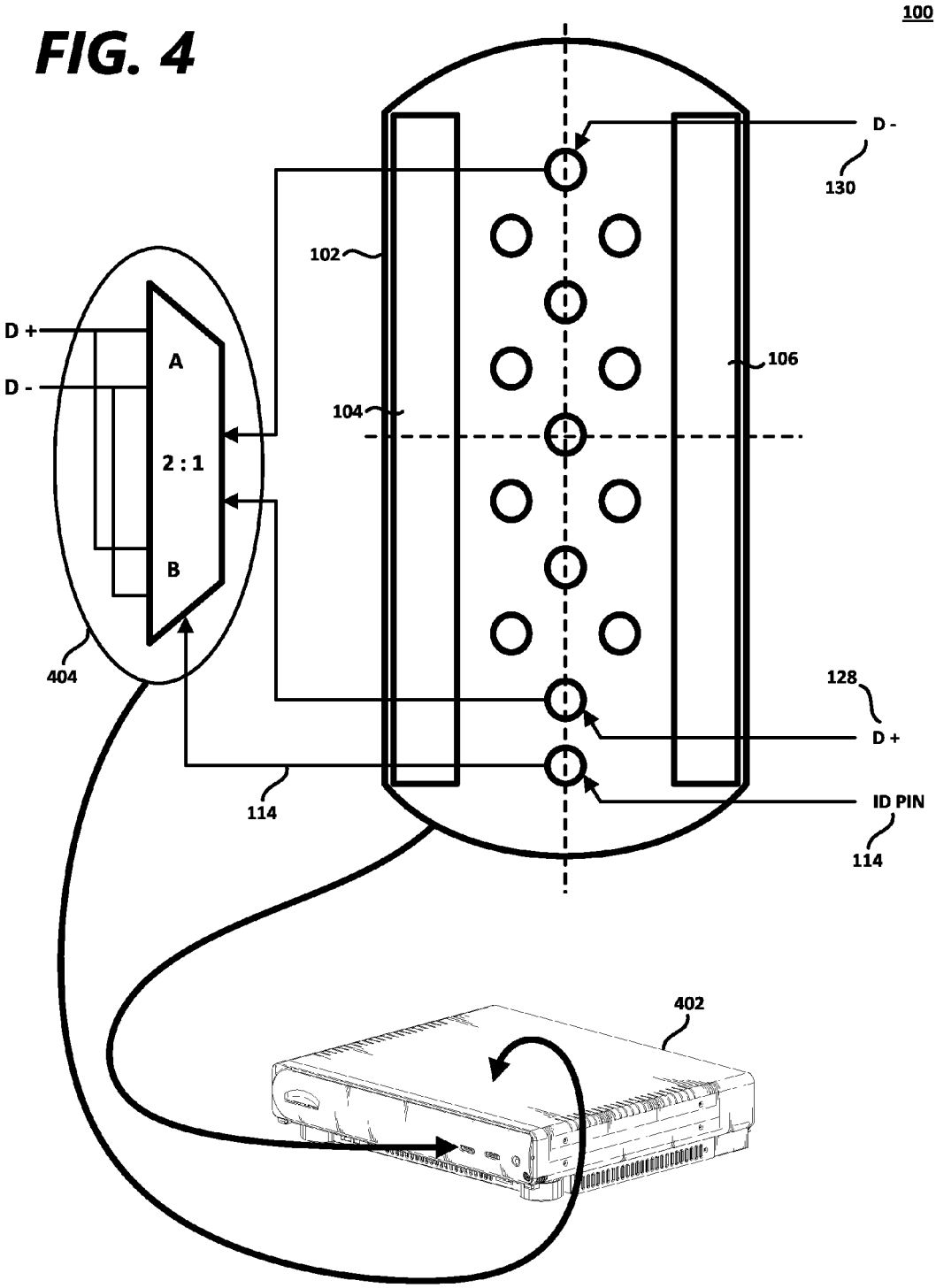
FIG. 4 is a representation of a device according to one embodiment, configured with a power and data connector according to one embodiment.

FIG. 4 is a representation of a device according to one embodiment, configured with a power and data connector according to one embodiment. FIG. 4 shows an electronic device 402, configured according to one embodiment. For example, the electronic device 402 may comprise a data storage device. In this embodiment, the electronic device 402 may comprise a (e.g., 2:1) multiplexer 404 whose select pin may be coupled to the connector orientation conductor 114. According to one embodiment, the multiplexer 404 may be configured to select polarities of the first and second legacy data conductors when the connector 100 is magnetically-connected to the mating connector in the first or in the second orientation. In a first orientation, the electronic device 402 may be configured to supply power of a first polarity to conductor 130 and to supply power of a second polarity to conductor 128, depending upon the orientation of the connector 100. Indeed, the connector orientation conductor (ID PIN) 114 may be configured to control the multiplexer 404 to enable the D+ and D− signals of the USB Legacy Low/Full/High Speed to be swapped. In this manner, the connector orientation conductor 114 serves as a plug polarity indicator since, according to one embodiment, it may be the only non-symmetrical pin on the connector 100. The connector orientation conductor 114, according to one embodiment, may either connect to ground or float when connected to the mating connector on the electronic device 402, depending on the orientation of the connector 100. This will pull the SELECT pin of the multiplexer 404 to a logical Low if connected to ground, and the SELECT pin will stay at a logical High if the connector orientation conductor 114 is floating. This, then, will either leave intact or flip the polarity of the legacy power conductors D+ and D− through the multiplexer 404.

A newly introduced (as of this writing) Type-C USB connector adds the support of Power Delivery through communication Channels. The Type-C USB connector connects to both hosts and devices, replacing various Type-B and Type-A connectors and cables. The 24-pin double-sided configuration of the Type-C USB connector provides four power/ground pairs, two differential pairs for USB 2.0 data bus (though only one pair is implemented in a Type-C cable), four pairs for high-speed data bus, two "sideband use" pins, and two configuration pins for cable orientation detection, dedicated biphase mark code (BMC) configuration data channel, and power for active cables. Connecting an older device to a host with a Type-C receptacle requires a cable or adapter with a Type-A or Type-B plug on one end and Type-C on the other end.

Figure 5:
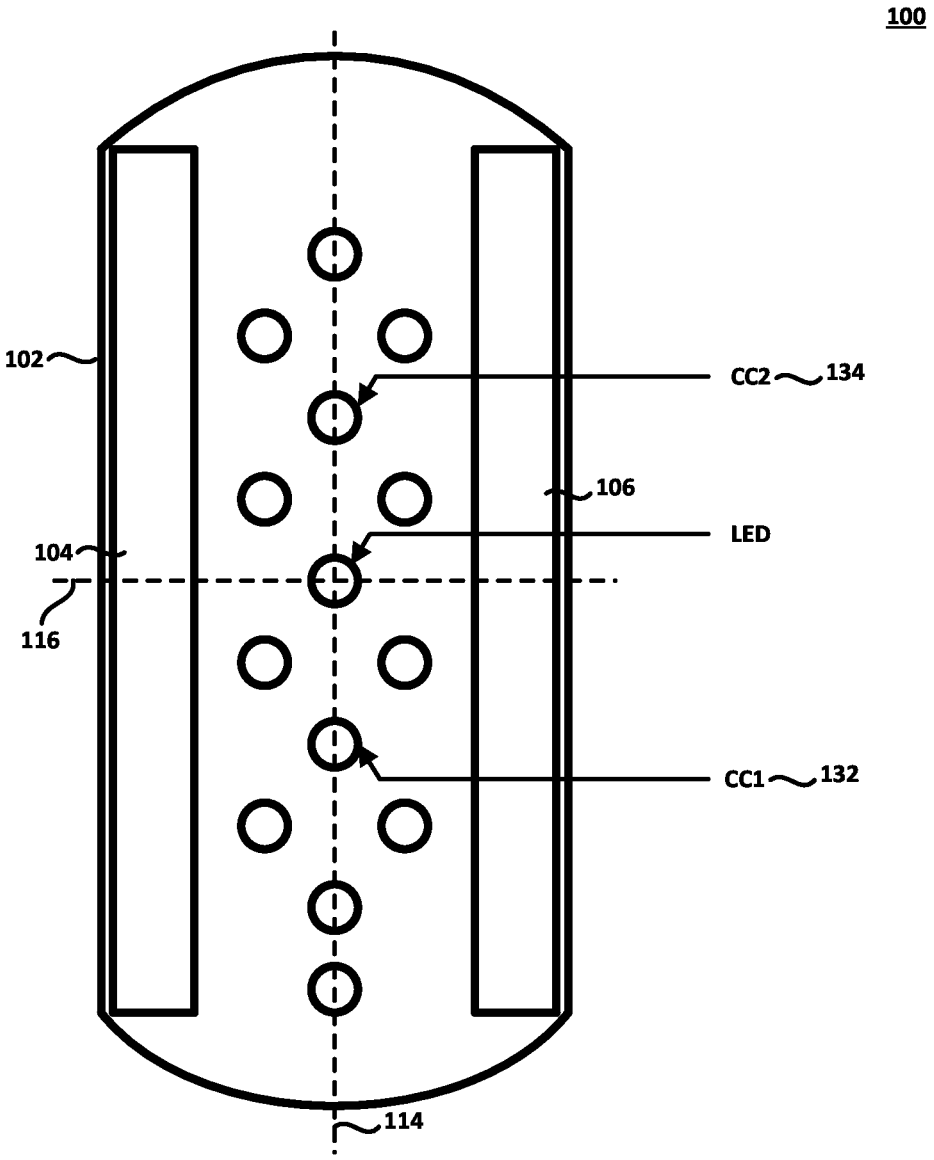
FIG. 5 is a representation of a power and data connector according to one embodiment.

Full-featured USB Type-C cables are active, electronically marked cables that contain a chip with an ID function based on the configuration data channel and vendor-defined messages from the USB Power Delivery 2.0 specification. Channel Configuration pins CC1 and CC2, shown at 134 and 132 in FIG. 5, may be configured to comply with Power Deliver Specification 1.2 and Type-C USB connectors. Per the Type-C specification, Channel Configuration pins CC1 132 and CC2 134 are reversible, being disposed symmetrically with respect to the second axis 116, and may be configured to function as a channel to negotiate the appropriate USB power delivery per its specification between the consumer and provider sides. These conductors are, therefore, configured as channels for power delivery when the connector 100 is magnetically-connected to the mating connector in either the first or in the second orientation 180 degrees from the first orientation.

According to one embodiment, the power, ground, data connector orientation conductors may be arranged in three rows of conductors as shown in the figures. Alternatively, the power, ground, data connector orientation conductors may be arranged in two rows. As also shown in the figures, the only non-symmetrically-disposed conductor on the connector 100 may be the connector orientation conductor 114, although that need not be the case.

Figure 6:
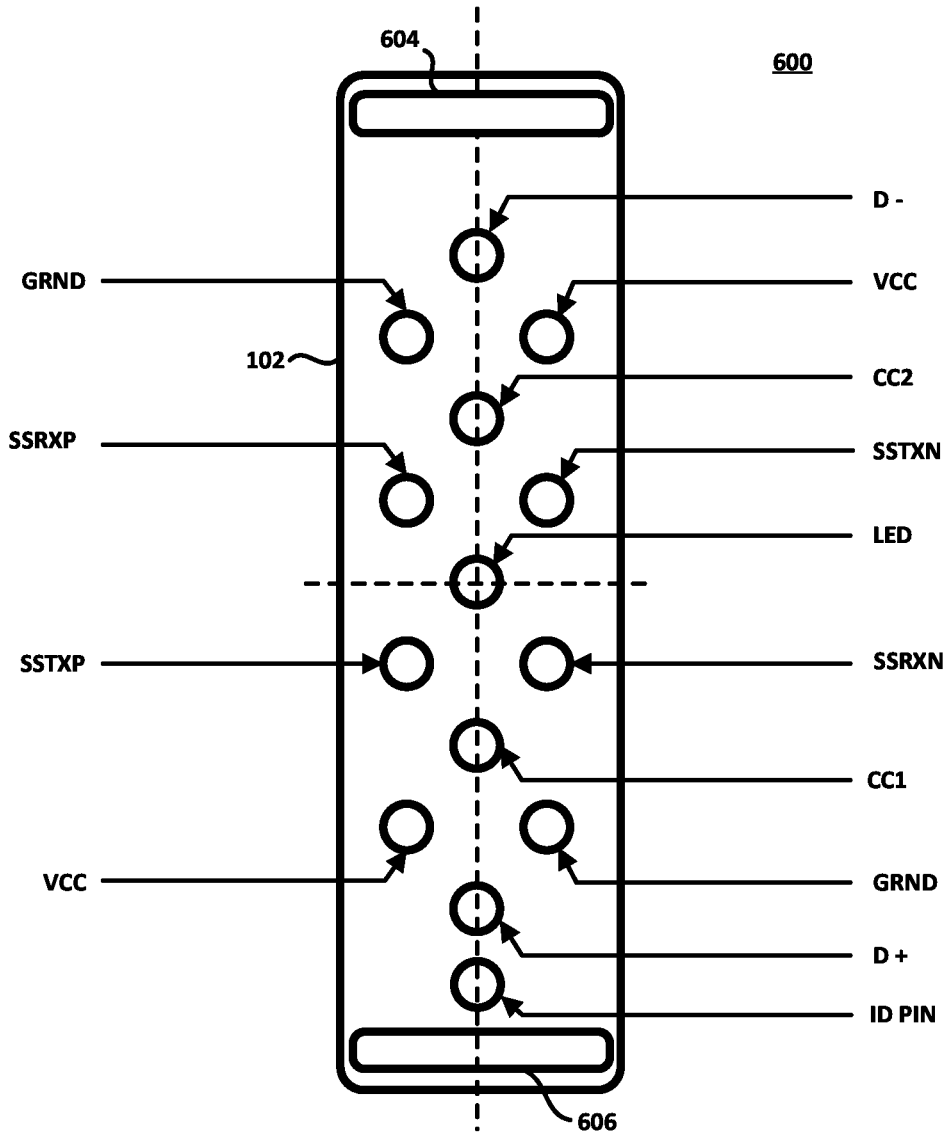
FIG. 6 is a representation of another power and data connector according to one embodiment.

FIG. 6 is a representation of another power and data connector according to one embodiment. As shown, the physical form factor of the connector 600 is different than that shown relative to FIGS. 1-5. For instance, the connector housing may be somewhat more rectangular and narrow and the first and second magnets may be disposed parallel to the shorter sides of the connector 600. Indeed, in FIG. 6, the first and second magnets 604, 606 are shown disposed at the top and bottom of the connector 600, in contrast to the sides thereof, as shown in FIGS. 1-5. The other conductors shown in FIG. 6 may correspond to and may be disposed similarly to their counterparts shown in FIGS. 1-5.

Figure 7:
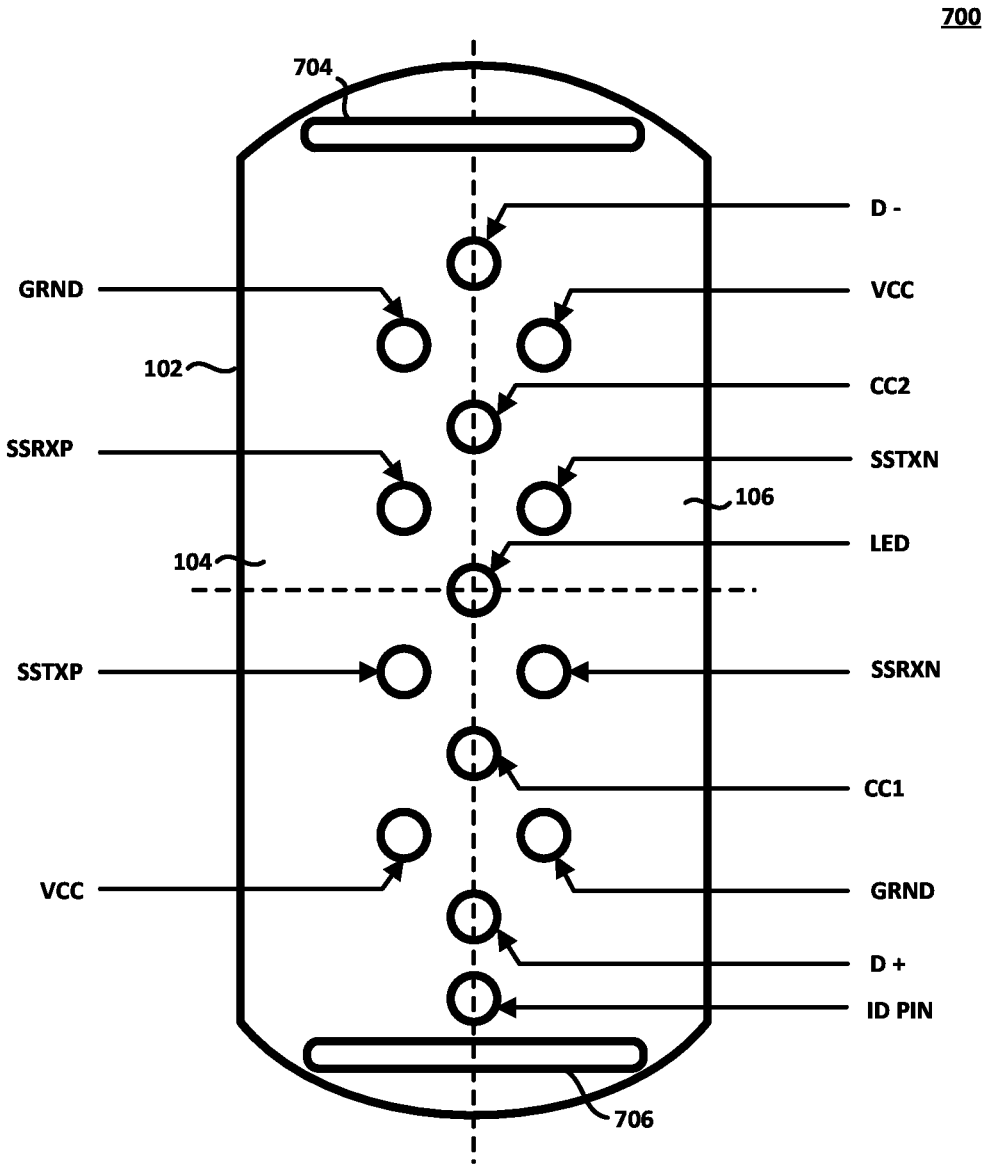
FIG. 7 is a representation of another power and data connector according to one embodiment.

Other implementations are possible. For example, FIG. 7 shows a connector 700 according to one embodiment. The conductors shown in FIG. 7 are identical to those shown relative to FIGS. 1-5, but the position of the first and second magnets has been swapped to the top and bottom (the short sides) of the connector 700, as compared to the (long) sides thereof.

Significantly, the present disclosure defines embodiments comprising a magnetic (e.g., USB SuperSpeed and SuperSpeed+) connector and representative conductor arrangements therefor, featuring full reversibility of the plug relative to the corresponding electronic device, as well as support for Power Delivery, optionally along with driving an external LED mounted on the device side or the receptacle's plug side. A connector according to one embodiment may enable fully sealed data storage devices such as hard disk drives, solid state data storage devices and hybrids thereof, since the connector is, in effect, a magnetic latch and is fully reversible. For example, a conventional USB Micro B connector may be replaced with a ruggedized connector according to one embodiment having a much higher mean time between failure (MTBF) in which the rate of wear and tear is smaller as compared with existing connectors. According to one embodiment, the light through the LED connector 118 may be modulated according to the activity or activity level of the data storage device or other electronic device. The LED connector 118, in this manner, avoids the necessity of drilling on the connector enclosure for light pipe or lens, thereby simplifying the mechanical design of both the electronic device and the connector 100.

While certain embodiments of the disclosure have been described, these embodiments have been presented by way of example only, and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall to within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

The invention claimed is:

1. A connector, comprising:

at least one power conductor configured to supply power to an electronic device;

at least one ground conductor to supply a ground to the electronic device;

at least one data conductor configured to carry data to or from the electronic device;

a connector orientation conductor that is separate from the at least one power conductor, the at least one ground conductor, and the at least one data conductor, the connector orientation conductor being configured to electrically indicate an orientation of the connector;

a first magnet on a first side of the connector; and a second magnet on a second side of the connector, wherein the connector is reversible such that the connector is magnetically-connectable to a mating connector in a first orientation and in a second orientation that is 180 degrees from the first orientation, the connector being operative to carry data and power to and/or from the mating connector when connected to the mating connector in the first orientation or in the second orientation, as indicated by the connector orientation conductor.

2. The connector of claim 1, wherein the connector is Universal Serial Bus (USB) compatible.

3. The connector of claim 1, further comprising a light-emitting diode (LED) connector coupled to a LED configured to illuminate when the connector is connected to the mating connector and data flows between the connector and mating connector.

4. The connector of claim 3, wherein the LED connector is configured to show illumination on an outside surface of the connector when the connector is magnetically-connected to the mating connector and data flows between the connector and mating connector.

5. The connector of claim 3, wherein the LED conductor is substantially centered on the connector.

6. The connector of claim 1, wherein the at least one data conductor comprises a first differential receiver conductor, a second differential receiver conductor, a first differential transmitter conductor and a second differential transmitter conductor.

7. The connector of claim 6, wherein the connector orientation conductor is further configured to enable a determination of polarities of the first and second differential receiver conductors and to enable a determination of polarities of the first and second differential transmitter conductors when the connector is magnetically-connected to the mating connector in the first or in the second orientation.

8. The connector of claim 6, wherein the at least one data conductor further comprises a first legacy data conductor and a second legacy data conductor.

9. The connector of claim 8, wherein the connector orientation conductor is further configured to control a multiplexer that is configured to select polarities of the first and second legacy data conductors when the connector is magnetically-connected to the mating connector in the first or in the second orientation.

10. The connector of claim 1, wherein the power, ground, data, and connector orientation conductors are arranged in one of two and three rows of conductors.

11. The connector of claim 1, wherein the connector orientation conductor is the only non-symmetrically-disposed conductor on the connector.

12. The connector of claim 1, wherein the at least one power conductor comprises a first power conductor and a second power conductor, each disposed such that a power connection is made when the connector is magnetically-connected to the mating connector in the first or in the second orientation.

13. The connector of claim 1, wherein the at least one ground conductor comprises a first ground conductor and a second ground conductor, each disposed such that a ground connection is made when the connector is magnetically-connected to the mating connector in the first or in the second orientation.

14. The connector of claim 1, further comprising a first channel configuration conductor and a second channel configuration conductor, each being configured as a channel for power delivery when the connector is magnetically-connected to the mating connector in the first or in the second orientation.

15. A cable, comprising:

a plurality of wires, terminating in, at least one end thereof, a connector that comprises:

at least one power conductor configured to supply power to an electronic device;

at least one ground conductor to supply a ground to the electronic device;

at least one data conductor configured to carry data to or from the electronic device;

a connector orientation conductor that is separate from the at least one power conductor, the at least one ground conductor, and the at least one data conductor, the connector orientation conductor being configured to electrically indicate an orientation of the connector;

a first magnet on a first side of the connector; and a second magnet on a second side of the connector, wherein the connector is reversible such that the connector of the cable is magnetically-connectable to a mating connector of an electronic device in a first orientation and in a second orientation that is 180 degrees from the first orientation, the connector being operative to carry data and power to and/or from the mating connector of the electronic device when connected to the mating connector in the first orientation or in the second orientation, as indicated by the connector orientation conductor.

16. The cable of claim 15, wherein the plurality of wires terminate, at another end thereof, in a Universal Serial Bus (USB) connector.

17. An electronic device, comprising:

a body; and a connector attached to the body of the electronic device, wherein the connector comprises:

at least one power conductor configured to supply power to the electronic device;

at least one ground conductor to supply a ground to the electronic device;

at least one data conductor configured to carry data to or from the electronic device;

a connector orientation conductor that is separate from the at least one power conductor, the at least one ground conductor, and the at least one data conductor, the connector orientation conductor being configured to electrically indicate an orientation of the connector;

a first magnet on a first side of the connector; and a second magnet on a second side of the connector, wherein the connector is connectable to a mating connector such that the mating connector is magnetically-connectable to the connector in a first orientation or in a second orientation that is 180 degrees from the first orientation, the mating connector being operative to carry data and power to and/or from the connector of the electronic device when connected to the connector in the first orientation and in the second orientation, as indicated by the connector orientation conductor.

18. The electronic device of claim 17, wherein the connector is Universal Serial Bus (USB) compatible.

19. The electronic device of claim 17, wherein the connector further comprises a light-emitting diode (LED) connector coupled to a LED configured to illuminate when the connector is connected to the mating connector.

20. The electronic device of claim 17, wherein the at least one data conductor comprises a first differential receiver conductor, a second differential receiver conductor, a first differential transmitter conductor and a second differential transmitter conductor.

21. The electronic device of claim 20, wherein the connector orientation conductor is further configured to enable a determination of polarities of the first and second differential receiver conductors and to enable a determination of polarities of the first and second differential transmitter conductors when the connector is magnetically-connected to the mating connector in the first or in the second orientation.

22. The electronic device of claim 20, wherein the at least one data conductor further comprises a first legacy data conductor and a second legacy data conductor.

23. The electronic device of claim 20, further comprising a multiplexer coupled to the connector, wherein the multiplexer is configured to select polarities of the first and second legacy data conductors when the mating connector is magnetically-connected to the connector of the electronic device in the first or in the second orientation.

24. The electronic device of claim 17, wherein the power, ground, data, and connector orientation conductors are arranged in one of two and three rows of conductors.

25. The electronic device of claim 17, wherein the connector orientation conductor is the only non-symmetrically-disposed conductor on the connector.

26. The electronic device of claim 17, wherein the at least one power conductor comprises a first power conductor and a second power conductor, each disposed such that a power connection is made when the connector is magnetically-connected to the mating connector in the first or in the second orientation.

27. The electronic device of claim 17, wherein the at least one ground conductor comprises a first ground conductor and a second ground conductor, each disposed such that a ground connection is made when the mating connector is magnetically-connected to the connector in the first or in the second orientation.

28. The electronic device of claim 17, wherein the connector further comprises a first channel configuration conductor and a second channel configuration conductor, each being configured as a channel for power delivery when the mating connector is magnetically-connected to the connector in the first or in the second orientation.

* * * * *